US005116240A

United States Patent [19]

Wischhusen et al.

[11] Patent Number: 5,116,240

[45] Date of Patent: * May 26, 1992

[54] MULTI-PARTITION FOOD STORAGE AND MULTIPLE SERVING APPARATUS

[75] Inventors: Heiner Wischhusen; Hans Kehlbeck, both of Bremen, Fed. Rep. of Germany

[73] Assignee: Aladdin Synergetics, Inc., Nashville, Tenn.

[ * ] Notice: The portion of the term of this patent subsequent to May 21, 2008 has been disclaimed.

[21] Appl. No.: 622,000

[22] Filed: Dec. 4, 1990

Related U.S. Application Data

[63] Continuation of Ser. No. 360,145, Jun. 1, 1989, Pat. No. 5,016,756.

[51] Int. Cl.[5] ..... A45G 11/20

[52] U.S. Cl. ..... 206/545; 206/546; 206/499; 206/515

[58] Field of Search ..... 206/541, 545, 546, 549, 206/499, 515, 518; 210/412; 220/413, 415, 902

[56] References Cited

U.S. PATENT DOCUMENTS

| | | | |
|---|---|---|---|
| Re. 30,962 | 6/1982 | Bridges | 206/545 X |
| D. 165,640 | 1/1952 | Dyer et al. . | |
| D. 214,523 | 6/1969 | Stone . | |
| D. 249,774 | 10/1978 | Seager . | |
| D. 256,872 | 9/1980 | Otto . | |
| D. 271,932 | 12/1983 | Mosley . | |
| 2,147,886 | 2/1939 | Devine | 206/545 |
| 2,656,946 | 10/1953 | Clarke | 206/545 |
| 2,810,276 | 10/1957 | Murray . | |
| 2,944,694 | 7/1960 | Kinsey | 206/541 |
| 3,413,820 | 12/1968 | Paguin . | |
| 3,501,044 | 3/1970 | Stone . | |
| 3,532,247 | 10/1970 | Bridges . | |
| 3,591,768 | 7/1971 | Torres . | |
| 3,613,933 | 10/1971 | Pilz . | |
| 3,670,916 | 6/1972 | Alpent | 220/412 |
| 3,754,640 | 8/1973 | Bridges . | |
| 3,799,386 | 3/1974 | Madalin et al. | 220/902 |
| 3,845,875 | 11/1974 | Douglas et al. | 206/545 |
| 3,848,766 | 11/1974 | Ganti et al. | 220/412 |
| 3,877,603 | 4/1975 | Holz . | |
| 3,938,688 | 2/1976 | Ryan | 206/545 |
| 3,974,640 | 8/1976 | Goltsos . | |
| 4,020,310 | 4/1977 | Souder, Jr. et al. . | |
| 4,494,654 | 1/1985 | Gunther et al. . | |
| 4,533,061 | 8/1985 | Herbst | 206/545 |
| 4,545,487 | 10/1985 | Asmus | 206/545 |
| 5,016,756 | 5/1991 | Wischhusen et al. | 206/545 |

FOREIGN PATENT DOCUMENTS

| | | | |
|---|---|---|---|
| 0081607 | 12/1981 | European Pat. Off. . | |
| 167666 | 1/1986 | European Pat. Off. | 220/415 |
| 0310698 | 10/1987 | European Pat. Off. . | |
| 362904 | 11/1922 | Fed. Rep. of Germany . | |
| 2524708 | 12/1976 | Fed. Rep. of Germany . | |
| 2363309 | 3/1978 | France . | |
| 2448885 | 10/1980 | France | 206/545 |
| 2459765 | 2/1981 | France | 206/545 |
| 6606963 | 3/1967 | Netherlands | 206/518 |
| 628036 | 10/1978 | U.S.S.R. | 206/541 |

OTHER PUBLICATIONS

The publication by Aladdin Synergetics entitled "Temp-rite Meal Systems" publication date Oct. 1987.

The publication by Aladdin Synergetics entitled "Temp-tainer Bulk Food Carrier" publication date Nov. 1988.

*Primary Examiner*—William I. Price

*Attorney, Agent, or Firm*—Banner, Birch, McKie & Beckett

[57] ABSTRACT

A multi-partition food storage and multiple serving apparatus is disclosed and includes a cover portion and a tray portion which mate to form a plurality of insulated cavities. A plurality of types of bowls are removably insertible in any of the cavities. Each bowl includes a separate lid and is capable of holding multiple serving portions. The insulation provided between each cavity allows simultaneous transport and storage of different foods which may be maintained at different temperatures.

7 Claims, 13 Drawing Sheets

MULTI-PARTITION FOOD STORAGE AND MULTIPLE SERVING APPARATUS

This application is a continuation Ser. No. 07/360,145, now U.S. Pat. No. 5,016,756, filed Jun. 1, 1989.

TECHNICAL FIELD

The present invention relates to a multiple-partition food storage and serving system, and more particularly, to a system for storing a plurality of servings of different types of foods such that each type of food is maintained in a separate insulated environment.

BACKGROUND OF THE INVENTION

Tray type food serving systems are known in the art, for example, the disposable tray with removable inserts disclosed in U.S. Pat. No. 3,501,044 to Stone. In the '044 patent, a light-weight frame includes a plurality of partitions dividing the frame into a plurality of individual tray portions. The tray portions are of different sizes and configurations, and include locking means for locking correspondingly sized dishes therein. However, there is no provision for insulating the food portions to maintain the temperature and to prevent transfer of heat from hot food to cold food. Additionally, the trays are designed to hold a single meal, such that each dish would hold a different portion of the meal. For example, the tray may be used to serve food on a commercial airliner. Thus, it would not be practical to use the tray of the '044 patent for serving different courses to large gatherings of people since each tray would only hold one meal, and since there is no provision for maintaining the temperature of each type of food.

In order to overcome the problem of thermal conductivity between adjacent dishes as in the tray of the '044 patent, trays with insulation between their compartments were developed. U.S. Pat. No. Re. 30,962 discloses such an insulated server tray wherein a plurality of different sized food holding receptacles or cavities are formed in the tray. The trays are designed so that one may be stacked on top of the other such that one tray serves as an enclosure for the tray immediately beneath it. Additionally, the upper tray provides peripheral insulation for the cavities of the tray immediately below. Therefore, a plurality of stacks of similarly shaped insulated food storage cavities is created. Food at essentially the same temperature is stored in cavities of the same stack such that a vertical thermal-column is created to maintain the food in each column at approximately the same temperature.

Another type of prior art insulated meal server uses both an insulated tray and an insulated cover. An example of such an insulated meal server is disclosed in U.S. Pat. No. 3,754,640 to Bridges. In the '640 patent, the server includes a tray with a plurality of different sized food holding receptacles or cavities formed therein, and a cover with a plurality of enclosed spaces which mate with the receptacles in the tray. The food holding receptacles are insulated from one another, as are the enclosed spaces, so that insulated food holding compartments are formed by the tray and cover. An insulated meal server which uses both an insulated tray and an insulated cover is also disclosed in U.S. Pat. No. 3,799,386 to Madalin et al.

The cavities of each tray portion in these insulated meal servers have a fixed size such that each tray may only be used to serve one meal to a single person. The trays are not designed such that a plurality of servings may be stored in each. Furthermore, the cavities are shaped to receive a specific size and shape of dish, bowl, cup or the like. Such insulated server trays thus cannot readily accommodate portions or food shapes beyond a standard size or shape. A person eating from the tray also cannot shift the relative position of the dishware fitted into the matingly shaped cavities.

Bulk food carriers are also known in the prior art. One type of a commercially available bulk food carrier includes a single, insulated, deep-dish server tray having a corresponding insulated cover. Each server tray is adapted to hold a standard serving pan such that the food contained in the pan is insulated from the surrounding environment. However, although each container is designed to allow bulk transport of multiple portions of a single type of food, the containers can only carry one type of food in an insulated manner. Each bulk food carrier cannot be easily adjusted so that a plurality of different sized serving portions may be transported, with the food portions insulated from each other. If it is desired to transport less than a full quantity of each type of food, there will be wasted space within each bulk food carrier. In order to transport and serve more than one type of food, a corresponding number of the carriers would have to be used to ensure that each food portion is securely transported in an insulated manner.

SUMMARY OF THE INVENTION

It is an object of the present invention to provide an insulated multi-partition food storage and serving apparatus such that multiple portions of a plurality of different types of foods may be stored, with each multiple food portion thermally insulated from the outside environment and from other multiple food portions.

It is another object of the present invention to provide a multi-partition food storage and transport apparatus such that the portion size for each different type of food may be adjusted so that only one storage and transport system can economically transport a desired quantity of a plurality of different types of foods.

It is another object of the present invention to provide a multi-partition food storage and serving apparatus having a tray portion and a cover portion such that the cover portion is securely fitted on the tray portion for insulating and transport, and such that a plurality of covered systems may be securely stacked for easy transport.

It is another object of the present invention to provide a multi-partition food storage and serving apparatus including tray portions and cover portions such that a plurality of tray portions may be securely stacked one on top of the other.

It is another object of the present invention to provide a multi-partition food storage and serving apparatus having integral hand grip portions for easy transport of a stack of the apparatuses.

It is another object of the present invention to provide a multi-partition food storage and serving apparatus having insulated cavities for storing a plurality of different sized covered food storage bowls such that the covered storage bowls may be interchangeably inserted in the cavities.

It is another object of the present invention to provide a multi-partition food storage and serving apparatus having a plurality of different sized and shaped food storage bowls such that the bowls hold multiple food servings and may be stacked after washing to allow compact drying, and such that the lids for the bowl units may also be stacked after washing to allow compact drying.

It is another object of the present invention to provide a multi-partition food storage and serving apparatus having a plurality of different depth bowls such that a multiple serving portion may be contained in one bowl, and a second bowl having a second multiple serving portion may be stacked on top of and out of contact with the food within the first bowl.

It is another object of the present invention to provide a multi-partition food storage and serving apparatus having a menu clip adapted to be snapped on to an integral hand grip of the apparatus such that a menu card may be inserted in the menu clip.

It is a further object of the present invention to provide a multi-partition food storage and serving apparatus having both cover and tray portions, such that reinforcing tacking notches are disposed in both the cover and tray portions.

Further objects, features and other aspects of this invention will be understood from the detailed description of the preferred embodiments of this invention with reference to the drawings.

BRIEF DESCRIPTION OF THE DRAWINGS

FIG. 4(*a*) is a side view of a plurality of stacked tray portions shown in the apparatus of FIG. 1, including a partially broken away view of the tray portions.

DETAILED DESCRIPTION OF THE INVENTION

Figure 1:
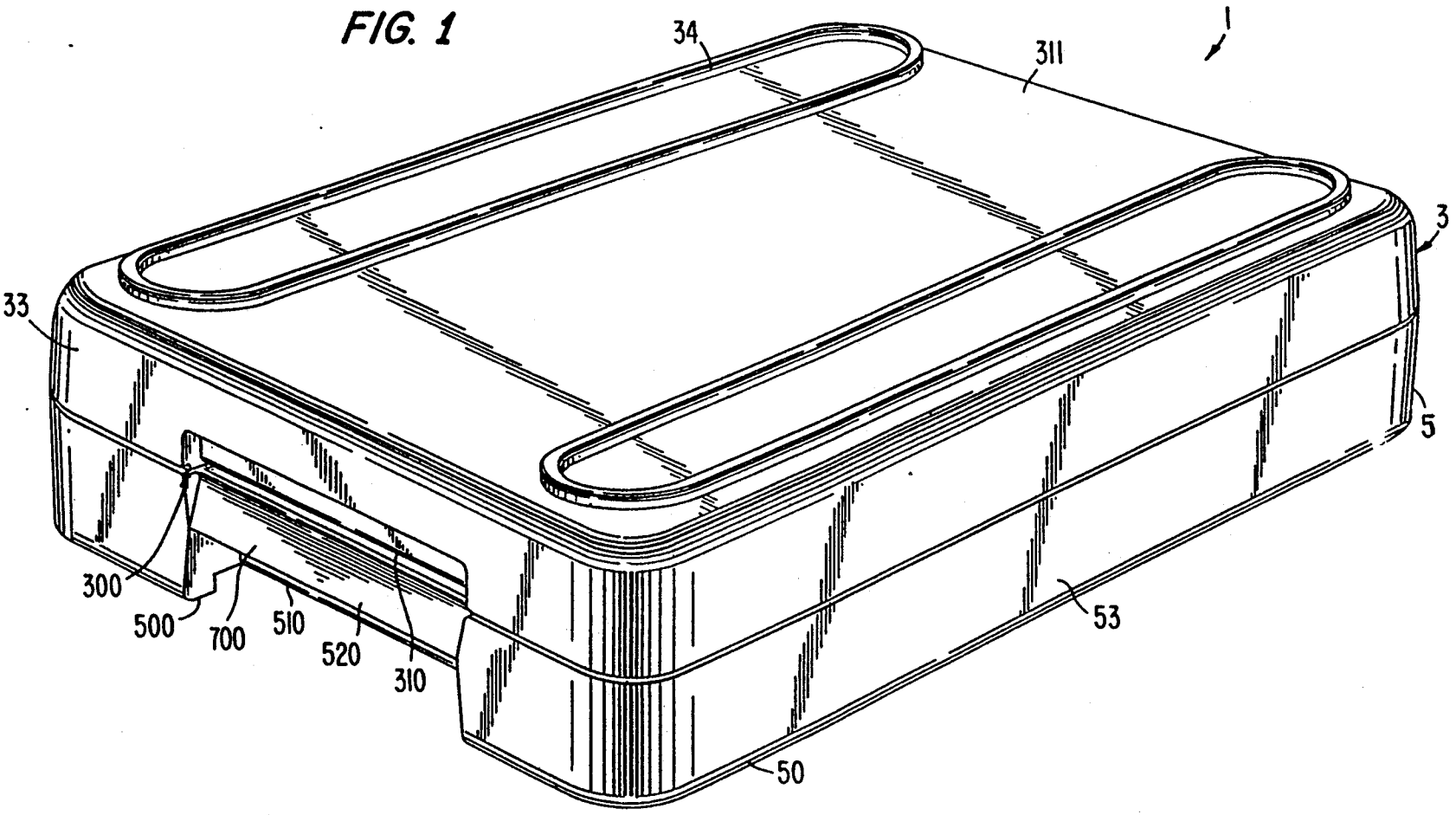
FIG. 1 is an overall perspective view of the multi-partition food storage and serving apparatus according to the present invention.

With reference to FIGS. 1–3, and 9 a multi-partition food storage and multiple serving apparatus according to the present invention is shown. Multi-partition food storage and multiple serving apparatus 1 includes tray portion 5 and cover portion 3 disposed thereon. Tray portion 5 includes bottom or base 51 and peripheral sidewalls 53 integrally formed with bottom 51 and extending upwardly from and completely around the periphery of bottom 51. Peripheral walls 53 terminate in upper horizontal surface 52. Cross walls 55 extend between opposite lengthwise peripheral walls 53 to divide the interior of tray 5 into a plurality of lower cavities 60. Projecting rim 56 extends around the perimeter of each cavity 60 at a level above horizontal surface 52. Horizontal surface 52 thus extends around the periphery of tray portion 5 and between adjacent rims. Encasing shell 554 and insulating material 600 received therein integrally form bottom 51, peripheral walls 53 and cross walls 55. Encasing shell 554 also forms surface 52. The encasing shell is preferably a relatively hard plastic, such as polypropylene and the insulating material is preferably a hardened plastic foam, such as rigid polyurethane foam. Other plastics such as polyethylene can be used for the shell. The shell is preferably formed by blow molding and the foam is injected through an aperture into the hollow interior of the blow molded part.

Cavities 60 are insulated from one another by insulation 600 in cross walls 55, and from the surrounding environment by insulation 600 in the surrounding peripheral walls 53 and bottom 51. The following description will refer to various surfaces of the encasing shell part of bottom 51 and walls 53 and 55. Lower cavities 60 include lower interior horizontal surface 59 and integrally formed peripheral cavity wall surfaces 57 which extend upwardly and incline outwardly with respect to surface 59. Lower interior surfaces 59 are disposed generally parallel to and slightly above a lower exterior surface 511 of bottom 51. Peripheral cavity wall surfaces 57 extend upwardly into integrally formed rims 56, which are integrally formed with and disposed above upper horizontal surface 52. In the area between two cavities 60, upper crossing surface 52*a* of surface 52 is formed between two adjacent peripheral rims 56, at a lower level than the top surface of rims 56, to form the base of a valley between the adjacent rims.

Figure 2:
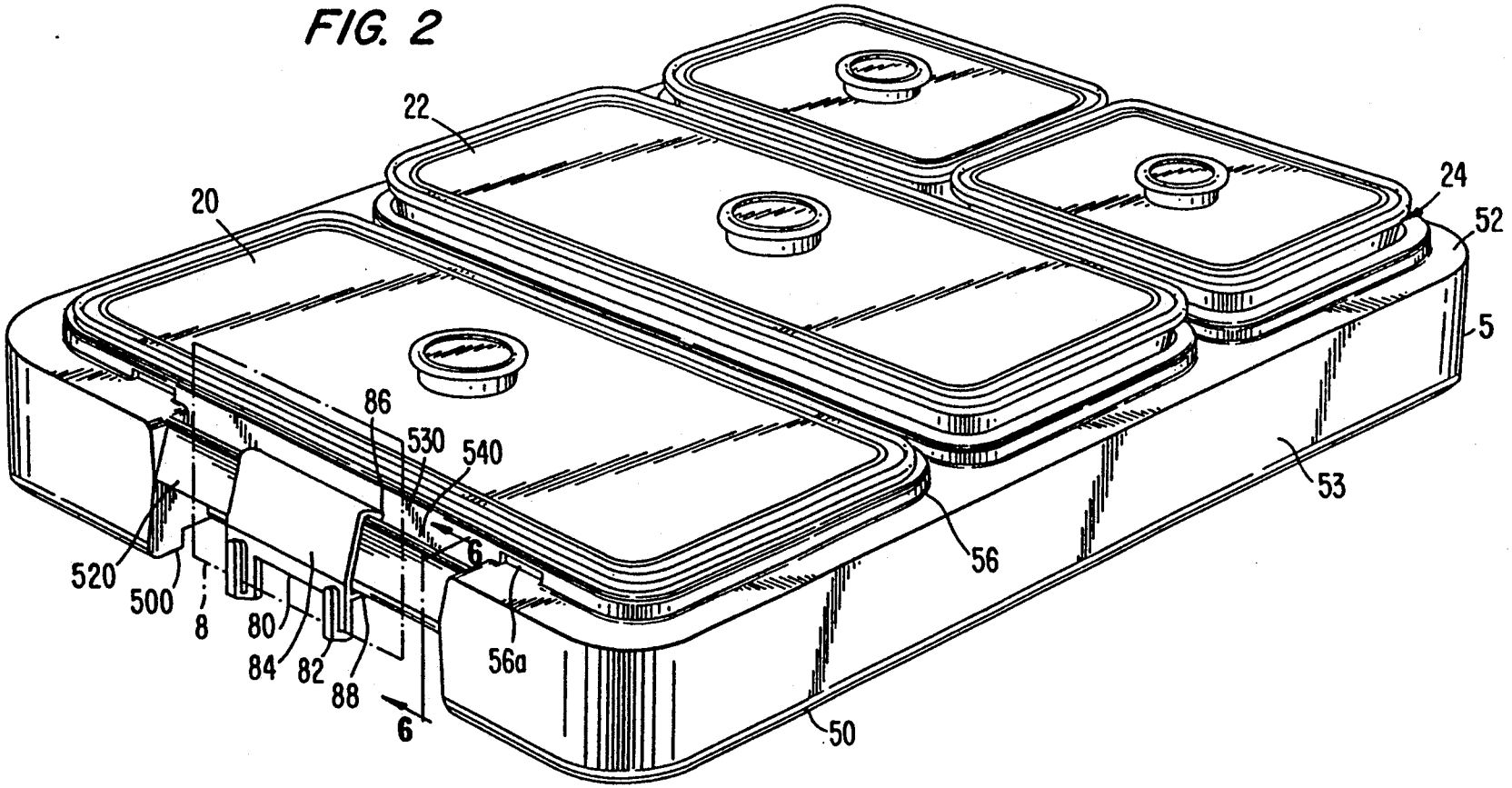
FIG. 2 is a perspective view of the tray portion of the multi-partition food storage and serving apparatus shown in FIG. 1, including a plurality of different sized bowls disposed in cavities in the tray portion.
Figure 5:
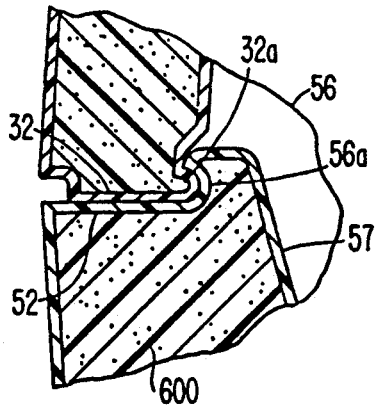
FIG. 5 is a closeup side view of circled region 5 as shown in FIG. 3.
Figure 9:
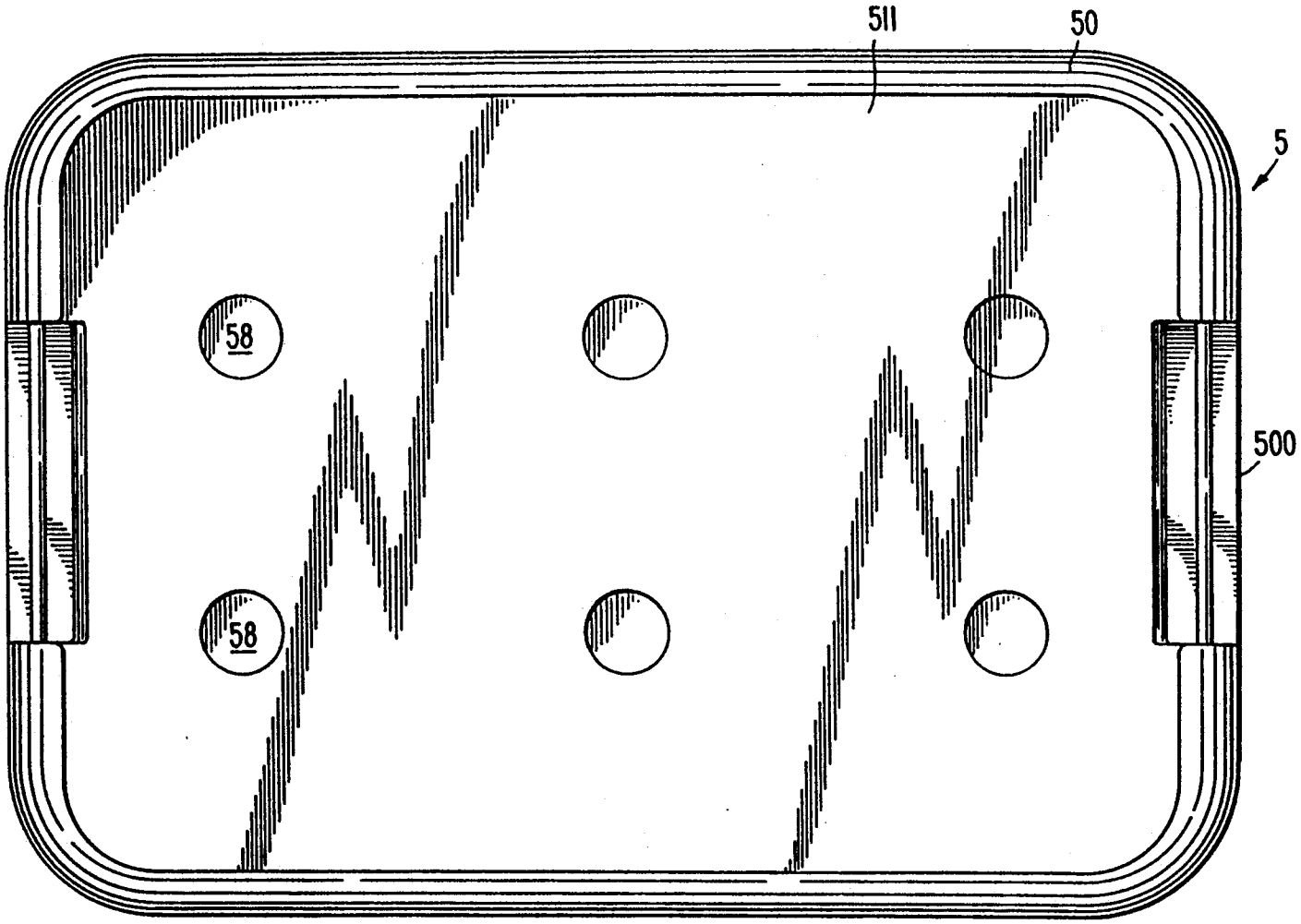
FIG. 9 is an underside view of the tray portion shown in FIG. 8.
Figure 10:
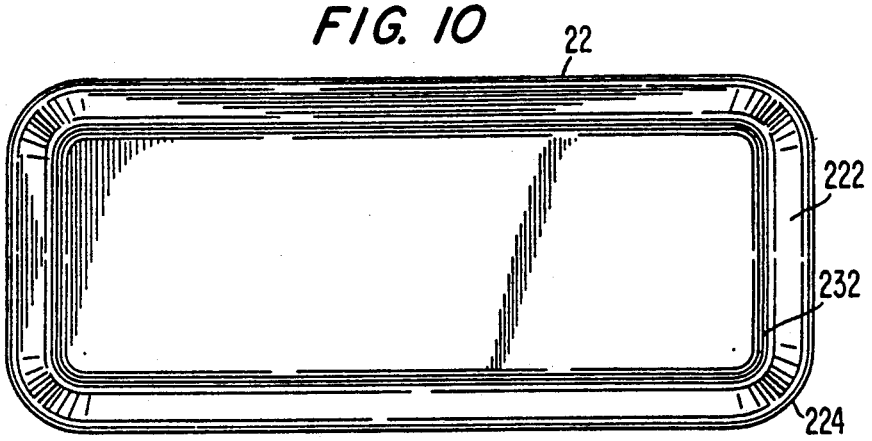
FIG. 10 is an overhead view of a first type of bowl as shown in FIG. 2.
Figure 11:
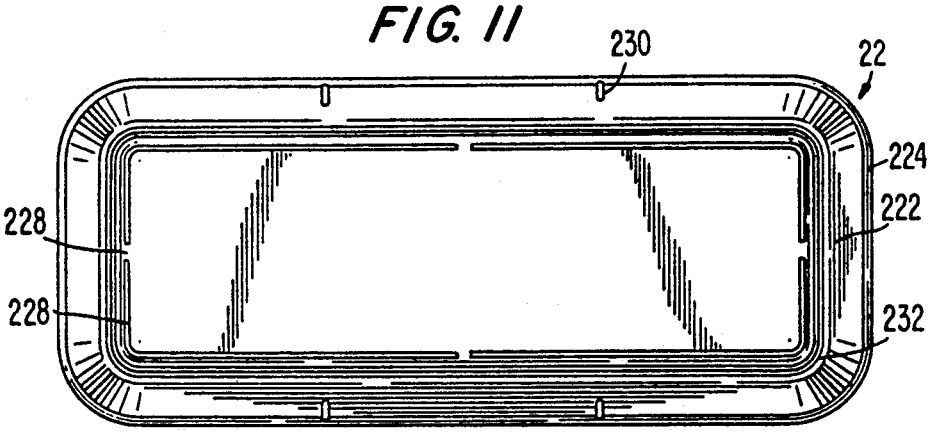
FIG. 11 is an underside view of the bowl shown in FIG. 10.
Figure 12:
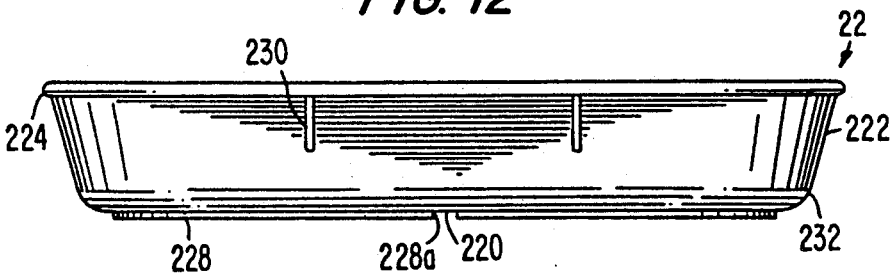
FIG. 12 is a long side view of the bowl shown in FIG. 10.
Figure 13:
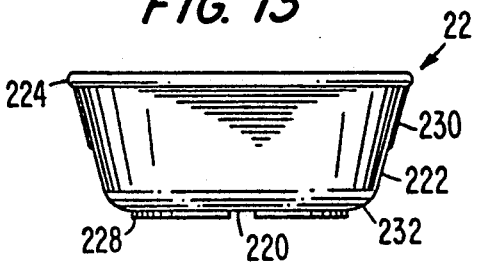
FIG. 13 is an end side view of the bowl shown in FIG. 10.
Figure 14:
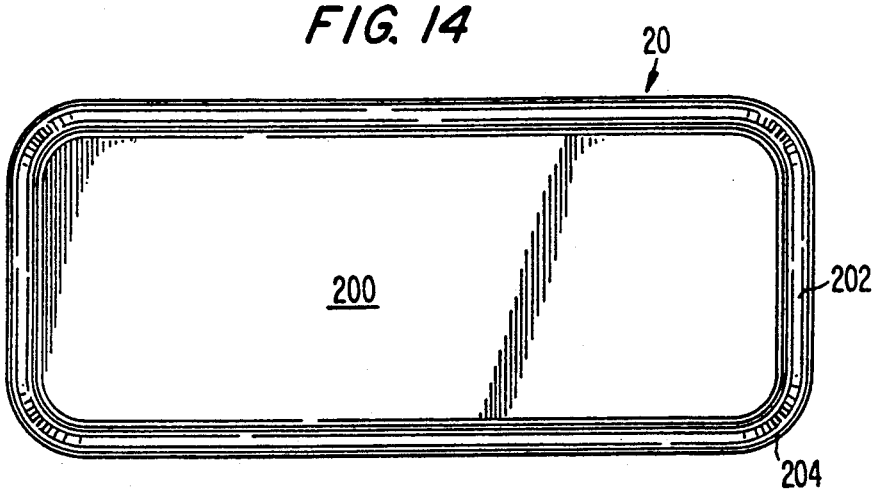
FIG. 14 is an overhead view of a second type of bowl shown in FIG. 2.
Figure 15:
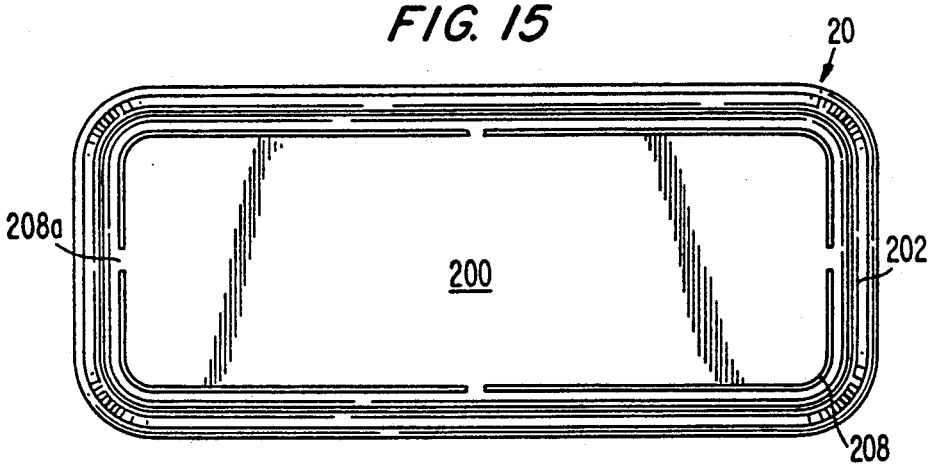
FIG. 15 is an underside view of the bowl as shown in FIG. 14.
Figure 16:
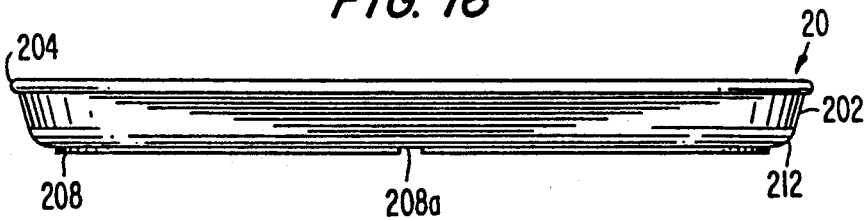
FIG. 16 is a long side view of the bowl shown in FIG. 14.
Figure 17:
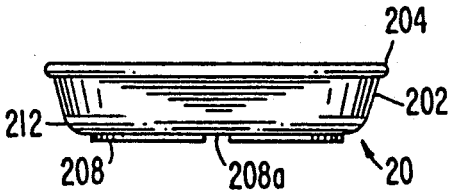
FIG. 17 is an end side view of the bowl shown in FIG. 14.
Figure 18:
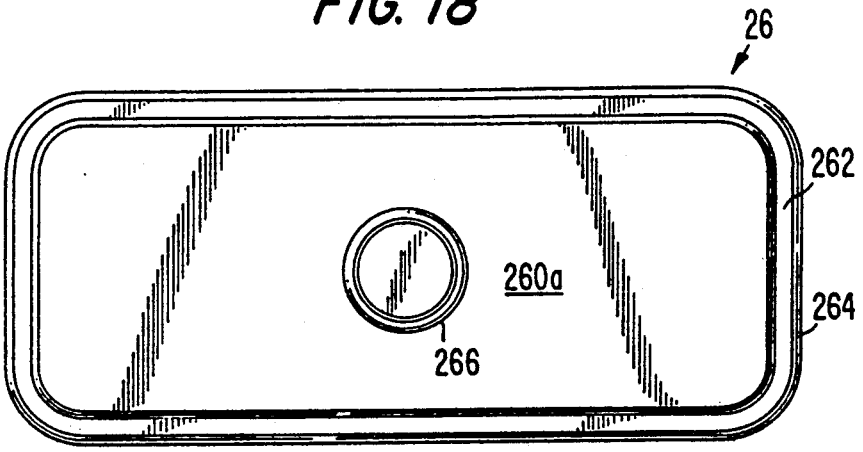
FIG. 18 is an overhead view of a lid for use with the bowls shown in FIGS. 10–17.
Figure 19:
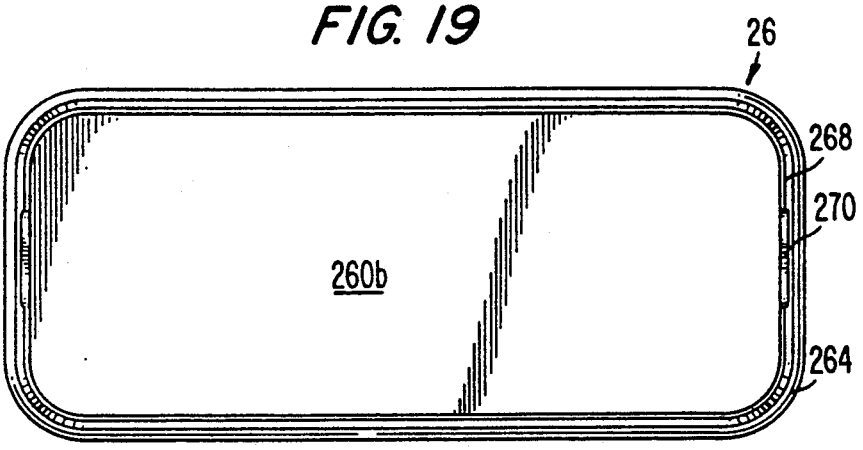
FIG. 19 is an underside view of the lid shown in FIG. 18.
Figure 20:
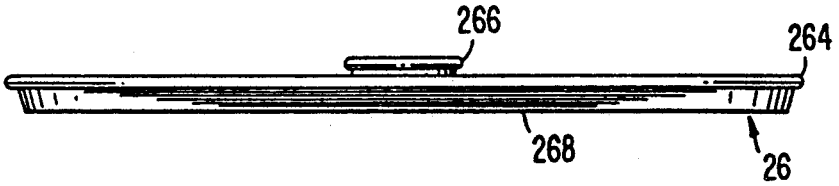
FIG. 20 is a long side view of the lid shown in FIG. 18.
Figure 21:
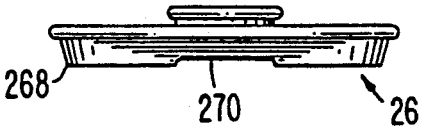
FIG. 21 is an end side view of the lid shown in FIG. 18.
Figure 22:
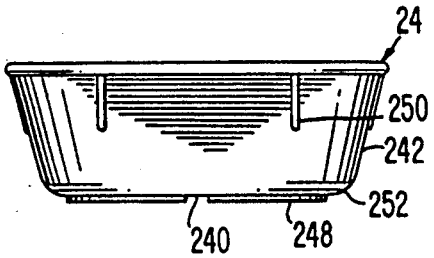
FIG. 22 is an end side view of a third type of bowl shown in FIG. 2.
Figure 23:
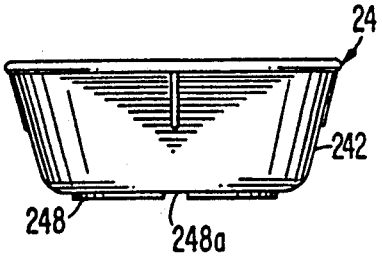
FIG. 23 is a different end side view of the bowl shown in FIG. 22.
Figure 24:
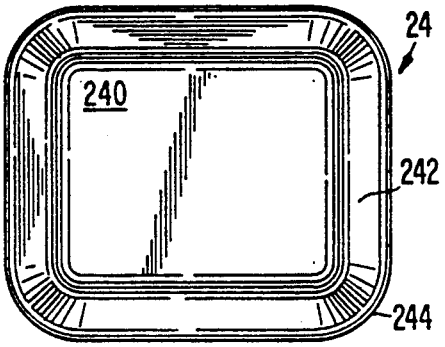
FIG. 24 is an overhead view of the bowl shown in FIG. 22.
Figure 25:
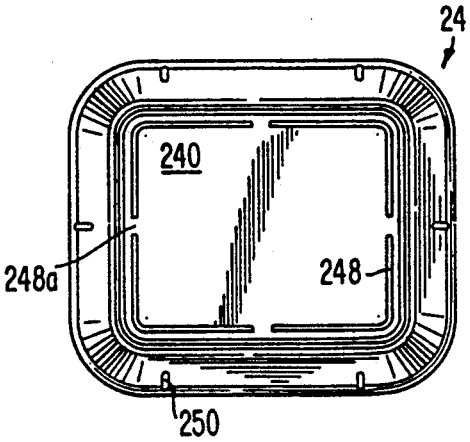
FIG. 25 is an underside view of the bowl shown in FIG. 22.
Figure 26:
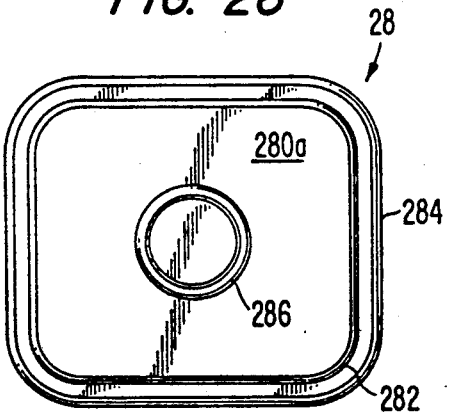
FIG. 26 is an overhead view of the lid for use with the bowl shown in FIGS. 22–25.
Figure 27:
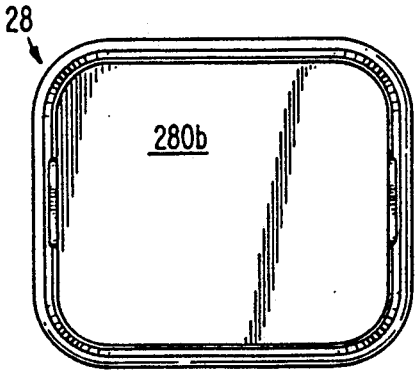
FIG. 27 is an underside view of the lid shown in FIG. 26.
Figure 28:
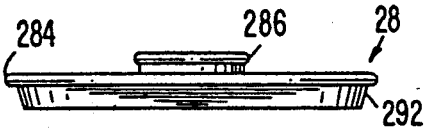
FIG. 28 is an end side view of the lid shown in FIG. 26.
Figure 29:
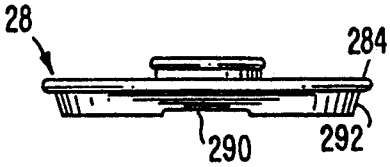
FIG. 29 is a different end side view of the lid shown in FIG. 26.

Tacking notches 58 are formed in lower surface 511 such that surface 511 is joined to adjacent lower interior surface 59 of cavities 60 at the location of tacking notches 58. As shown in FIG. 9, two tacking notches 58 are disposed beneath each cavity 60 and provide increased structural support for tray portion 5. However, more or less tacking notches 58 may be used as desired. With reference to FIGS. 2 and 5, rims 56 which are adjacent the short end side of tray portion 5 each include two indented portions 56*a* formed therein. Indented portions 56*a* are formed above and adjacent upper horizontal surface 52.

Figure 6:
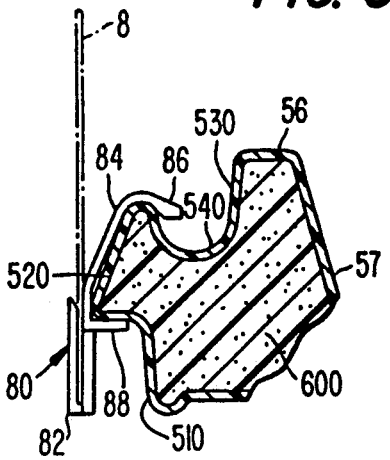
FIG. 6 is a cross-sectional view taken along the line 6—6 as shown in FIG. 2.
Figure 7:
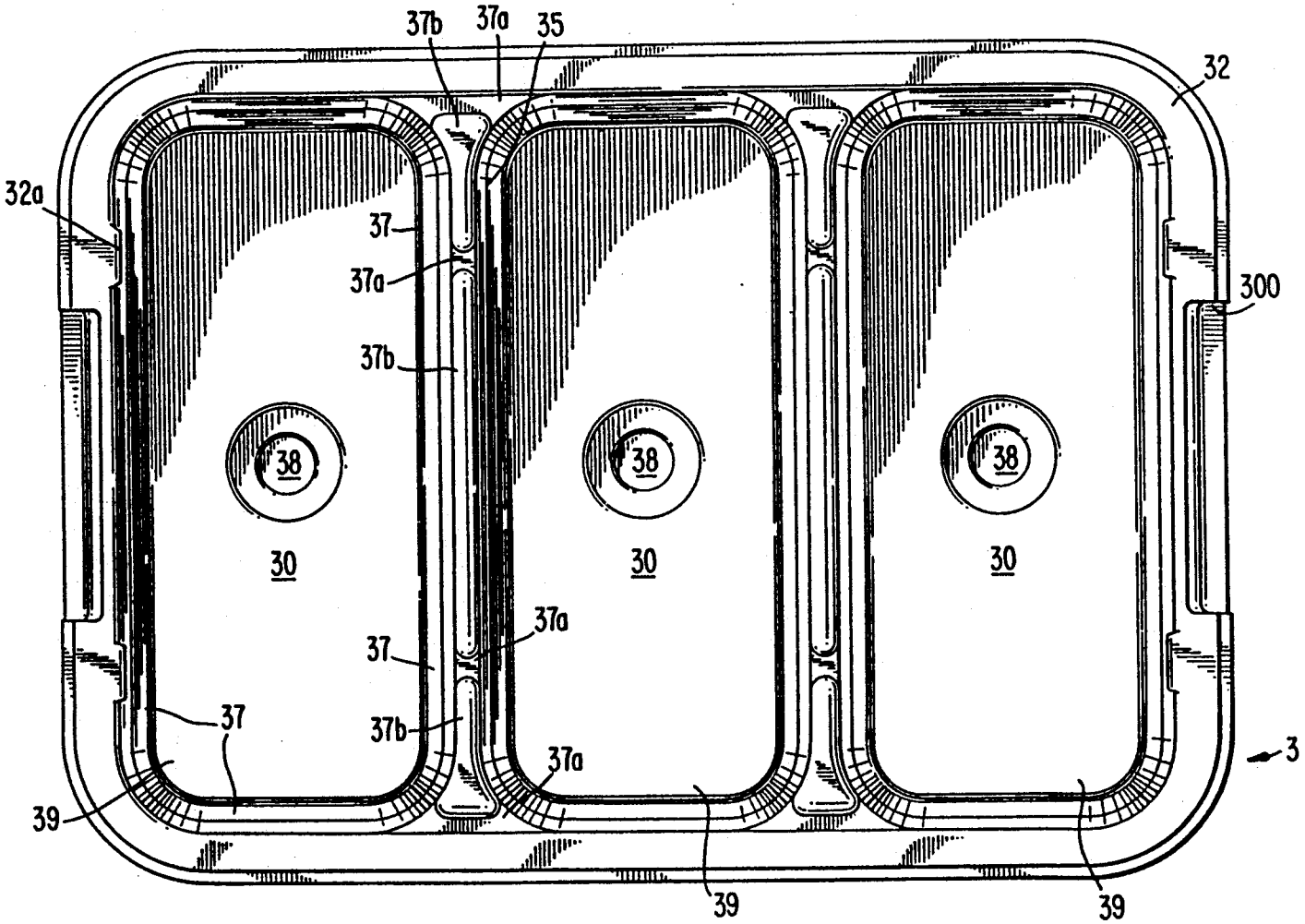
FIG. 7 is an underside view of a cover portion of the apparatus shown in FIG. 1.
Figure 8:
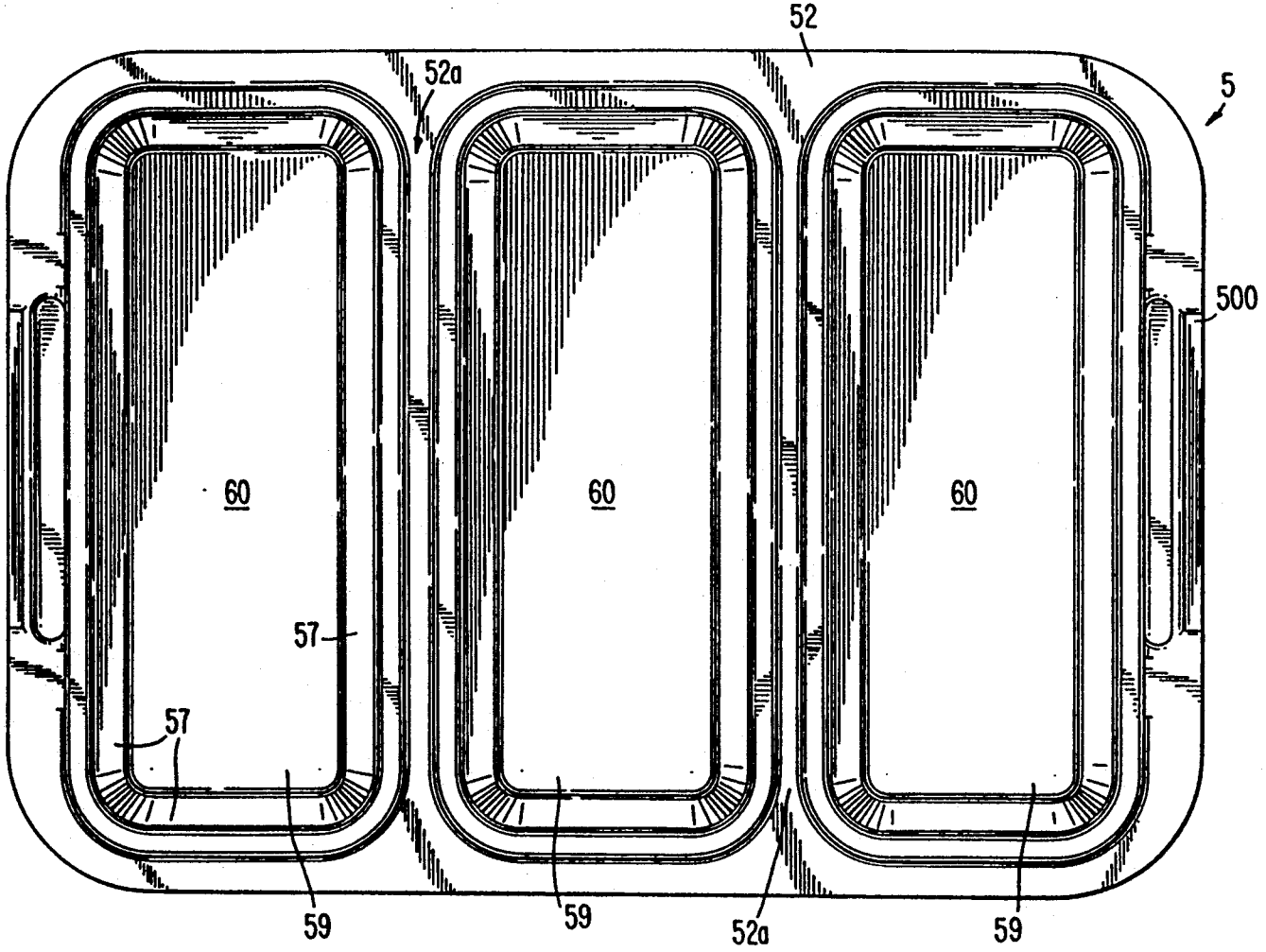
FIG. 8 is an overhead view showing the tray portion of the apparatus shown in FIG. 1.

With reference to FIGS. 2 and 6, the short side walls 53 each include lower handle cut-outs 500 disposed therein at a central location. Each handle cut-out 500 includes a lower handle grip indented surface 510 formed essentially parallel to the major surface of wall 53, and an inclined clip mounting surface 520 disposed above and outwardly of lower handle grip indented surface 510. Inclined clip mounting surface 520 extends upwardly into a curved surface, which extends downwardly into curved indented region 540, which further extends upwardly into lower recessed surface 530 adjacent rim 56. Surface 530 in fact forms a portion of the side surface of rim 56 at that location.

With reference to FIG. 2, menu clip 80 includes forward clip projections 82, an inclined support surface 84, upper locking projection 86 and lower locking projection 88. Menu clip 80 is locked onto inclined clip mounting surface 520 such that upper locking projection 86 extends over surface 520 and into curved indented region 540, and lower locking projection 88 extends beneath surface 520. Menu 8 is inserted in forward clip projections 82.

With respect to FIGS. 1, 3, 4 and 7, cover portion 3 is shown. Cover portion 3 includes top 31 and peripheral side walls 33 integrally formed with top 31 and extending downwardly from and completely around the periphery of top 31. Crosswalls 35 extend between opposite lengthwise side walls 33 to divide the interior of cover 3 into a plurality of upper cavities 30. As with tray 5, encasing shell 354 surrounding insulating material 600 therein integrally forms top 31, side walls 33 and cross walls 35 of cover 3. Two generally elliptically shaped projections 34 extend in the longitudinal direction along either side of upper exterior surface 311 of top 31.

Shell 354 also includes lower peripheral surface 32, integrally formed with peripheral side walls 33, and slightly set-in from the outer plane of surfaces 32. Each cavity 30 includes upper interior cavity surface 39 and peripheral cavity wall surfaces 37 extending downwardly and inclined outwardly from surface 39. Upper surfaces 39 are generally parallel to and disposed slightly below upper surface 311. Ridges 37*b* extend downwardly from crosswalls 35 and gaps 37*a* are located between segments of ridges 37*b*. Tacking notches 38, similar to tacking notches 58 are formed in upper interior cavity surfaces 39, such that surfaces 39 are joined to adjacent upper exterior surface 311. Upper handle cut-out 300 includes recessed surface 310, and is centrally formed in either short side of cover portion 3. Locking projections 32*a* extend inwardly fro the inner side of lower peripheral horizontal surface 32 on the short end sides of right and left cavities 30.

When cover portion 3 is disposed on tray portion 5, locking projections 32*a* fit within indented portions 56*a* formed on tray portion 5 to help securely hold cover portion 3 on tray portion 5. Additionally, lower peripheral horizontal surface 32 rests upon upper horizontal surface 52, with ridges 37*b* fitting in the valleys between adjacent rims 56 of cross walls 55, and resting upon upper crossing surfaces 52*a*. The inner side of lower peripheral surface 32 substantially contacts the outer sides of rims 56. Thus, when cover portion 3 is disposed on tray portion 5, they are secured against lateral movement with respect to each other. Upper cavities 30 are disposed above lower cavities 60 to create insulated bowl holding cavities 100. Cavities 100 are substantially of the same dimension, and are completely thermally isolated and insulated from each other and the outside environment by the foam insulated surfaces and walls of the tray portion and the cover portion. Additionally, upper handle cut-out 300 is disposed adjacent lower handle cut-out 500 to form handle grip 700 such that surface 310 is disposed above surface 520, with a small space therebetween to allow upper locking projection 86 of menu clip 80 to extend into curved indented region 540.

Figure 3:
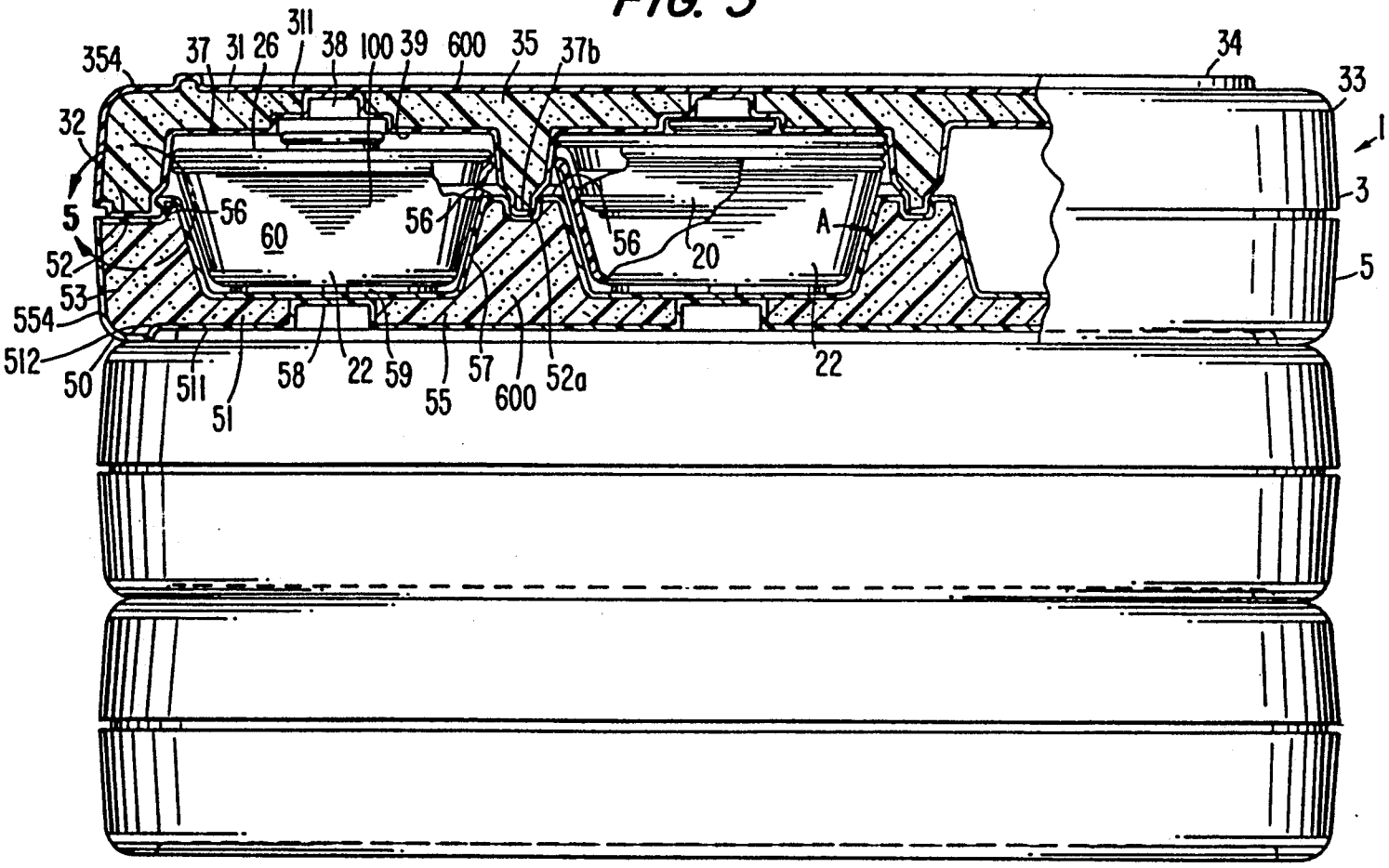
FIG. 3 is a side view of a plurality of the apparatuses shown in FIG. 1 stacked one on top of the other, including a partially broken away view of the top most apparatus.
Figure 4A:
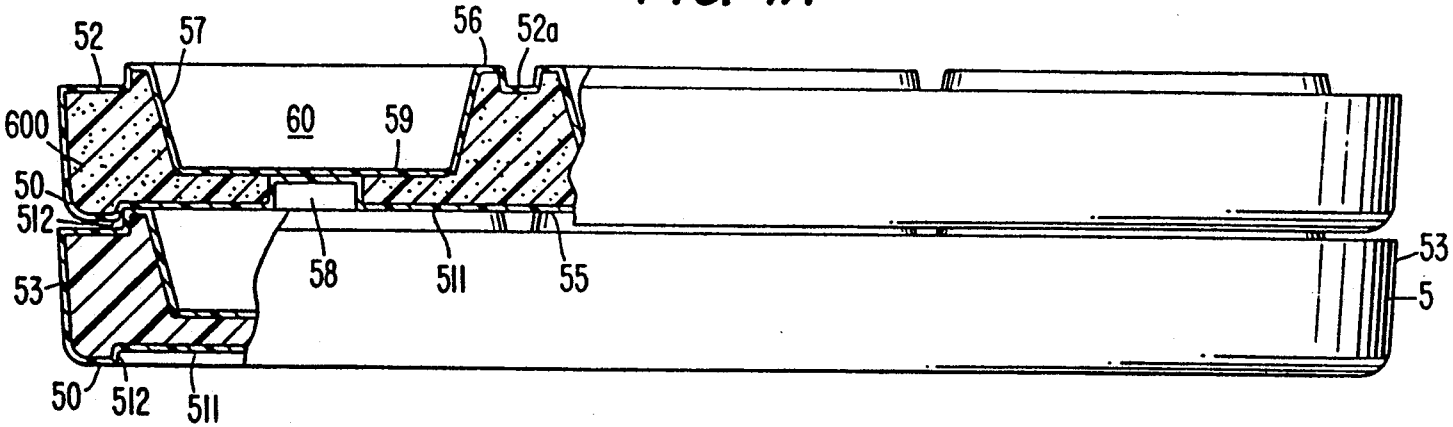
FIG. 4 is a side view of a plurality of stacked cover portions shown in the apparatus of FIG. 1, including a partially broken away view of the cover portions.

As best seen in FIGS. 4*a*and 9, peripheral support portion 50 joins side walls 53 to lower exterior surface 511 along a substantially vertical border portion 512. Bottom lower exterior surface 511 is stepped up from support portion 50. As shown in FIG. 3, a plurality of covered apparatuses 1 may be stacked one on top of the other such that peripheral support portions 50 rest upon upper surface 311 of cover portion 3 immediately below. Peripheral support portions 50 are disposed outwardly of the exterior length and rounded edges of elliptical projections 34 such that border portion 512 is in contact with projections 34. Thus, an upper apparatus 1 is secured against lateral movement with respect to a lower apparatus 1 immediately therebeneath. Therefore, as shown, three or more of the apparatuses may be securely stacked for transport.

Figure 4:
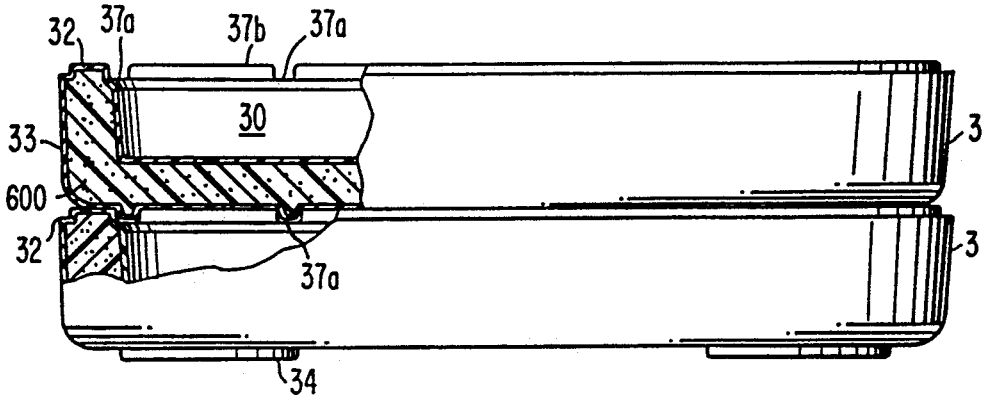

As shown in FIG. 4, a plurality of cover portions 3 may be stacked such that elliptical projections 34 fit within and in contact with gaps 37*a*between ridge segments 37*b*, and between ridge segments 37*b* and surface 32 to securely hold the cover portions against lateral movement. As shown in FIG. 4*a*, tray portions 5 may also be stacked such that portions of rims 56 fit within and in contact with lower exterior surface 511 of bottom 51 and border 512 of support portion 50 to secure the tray portions from movement with respect to each other. Thus the tray portions and the cover portions may be stored separately in this manner when not in use.

With reference to the remaining FIGS. 10–31, the bowls which are removably disposed in cavities 100 will be discussed. The bowls are securely held in the cavities such that one or more bowls held in any one cavity and substantially thermally insulated from bowls in any other cavity and the outside environment. All three types of bowl disclosed in the following are sized to hold multiple serving portions and may be removably inserted in any of identical bowl holding cavities 100.

With reference to FIGS. 10-13, a first type of bowl 22 is disclosed. Bowl 22 includes peripheral walls 222 integrally formed with bottom portion 220 at curved portion 232. Walls 222 slope upwardly and outwardly from bottom portion 220. Upper peripheral rims 224 are integrally formed with peripheral walls 222. Rims 224 are curved and extend over the exterior surface of wall 222 to form a lip. Vertical peripheral rib projections 230 are disposed on the exterior surfaces of the longer side peripheral walls 222 of bowl 22, extending downwardly from rims 224 to a location about halfway down the exterior surfaces. Bottom support ribs 228 are peripherally disposed on the exterior surface of bottom 220. Bottom ribs 228 include a plurality of openings **228*a* which separate bottom ribs 228 to allow water drainage through the openings. As discussed below, lid 26 is removably disposed on bowl 22. Bowl 22 and lid 26 are formed of a plastic or other suitable material and need not be sufficiently thick so as to provide thermal insulation for the multiple food portions disposed therein. A preferred material for bowl 22 and lid 26**, as well as the other bowls to be discussed is ABS, which has relatively high heat resistance. If higher heat resistance is required, such as where food is to be heated in the bowls, materials with even higher heat resistance could be used, such as polycarbonate and polysulphome.

With reference to FIGS. 2 and 3, bowl 22 is removably disposed in any one of lower cavities 60 such that bottom support ribs 228 rest on lower interior surface 59. Although bowl 22 is shown in FIG. 2 as being disposed in central cavity 60, it may in fact be removably disposed in any of the cavities. Bowl 22 is a full-sized or deep bowl such that walls 222 extend completely along the height of peripheral cavity wall surfaces 57, and substantially beyond the termination of projecting rims 56 of tray portion 5, such that rims 224 do not contact rims 56. This space or gap, preferably about one-quarter of an inch, between tray rim 56 and bowl rim 224 permits bowl 22 to be readily grasped for removal from tray portion 5. Additionally, since walls 222 are inclined in generally the same manner as cavity wall surfaces 57, bowls 22 may be tilted in cavity 60 as shown by the arrow A (FIG. 3) when cover portion 3 is removed, to provide easier serving capability. The tilting may be accomplished due to the slight space left between surfaces 57 and walls 222. As shown in FIG. 3, when cover portion 3 is disposed on tray portion 5, bowl 22 and lid 26 is securely held in cavity 100 and surrounded on all sides by foam insulation to maintain the temperature of the multiple food servings disposed in the bowl.

With reference to FIGS. 14-17, a second type of bowl 20 is disclosed. Bowl 20 is of essentially the same shape as bowl 22 and includes peripheral surface 202 integrally formed with bottom portion 200 at curved portion 212. Bowl 20 also includes bottom support ribs 208 including a plurality of openings **208*a* to allow water drainage through the openings. However, bowl 20 does not include peripheral ribs corresponding to ribs 230 of bowl 22. Bowl 20 also includes curved rim 204 having a lip extending over the outer surfaces of walls 202**.

With reference to FIG. 2, bowl 20 and lid 26 are removably disposed in left side cavity 60 although, they may be disposed in any of cavities 60. Bowl 20 is a fractional or shallow depth bowl. Thus, although bowl 20 has substantially the same length and width of bowl 22, peripheral walls 202 are only a fraction of the height of peripheral walls 222 of bowl 22. For example, bowl 20 may be a one half depth bowl 22. When bowl 20 is disposed in a cavity 60, it is supported within by rim 204 which rest directly on rim 56 of tray portion 5. Bowl 20 extends only partially downwardly along peripheral cavity surfaces 57, and bottom support ribs 208 do not contact lower interior surface 59.

With respect of FIGS. 18-21, lid 26 for use with both bowl 20 and 22 is shown. Lid 26 is generally rectangularly shaped and includes upper surface **260*a* and lower surface 260*b*. Upper inner peripheral projection 262 is formed on upper surface 260*a* and is set inwardly from the edge thereof. Handgrip 266 is centrally located on upper surface 260*a*. Peripheral rim 264 is integrally formed with surfaces 260*a* and 260*b* and is shaped as a rounded lip with an overhanging portion. Peripheral walls 268 extend downwardly and inwardly from lower surface 260*b*, at an inset position with respect to rim 264. Cut-outs 270 are formed in the short sides of peripheral wall 268. As shown in FIG. 2, lids 26 are disposed on bowls 20 or 22 such that rims 264 are supported by rims 204 or 224. Walls 268 extend within the closed bowl along walls 202 or 222 to secure lid 26 against lateral movement with respect to bowl 20 or 22**.

With reference to FIG. 22-25, a fractional length bowl 24 is shown. Fractional length bowl 24 is of a substantially similar structure as full-sized bowl 22, and is of substantially the same height. However, fractional length bowl 24 has only a fractional length, for example, a one half length such that two half-length bowls 24 fit within one cavity 60 as shown in FIG. 2. As shown, half-length bowls 24 are approximately square shaped. Fractional length bowl 24 includes peripheral wall 242 integrally formed with bottom 240 at rounded portion 252. Walls 242 slope upwardly and outwardly from bottom 240. Due to the sloping of walls 242, bowls 24 may be tilted similarly to bowl 22 in cavities 60. Rounded rim 244 includes a lip extending over the outer surface of walls 242. Vertical peripheral rib projections 250 extend downwardly from rim 244, on the outer surface of walls 242, about halfway down towards bottom 240. Additionally, peripheral bottom support ribs 248 are disposed on the outer surface of bottom 240, and include openings **248*a*** to allow water drainage through the openings.

With respect to FIGS. 26-29, lid 28 for bowl 24 is shown. Lid 28 is of generally the same shape as fractional-length bowl 24, for example, generally square-shaped. Lid 28 has substantially the same structure as lid 26, except for having a shorter length dimension. Lid 28 has an upper surface **280*a* and a lower surface 280*b*, and hand grip portion 286 extending from upper surface 280*a*. Inner peripheral projection 282 is disposed on upper surface 280*a*, and is set inward from the edge thereof. Peripherally disposed rim 284 is shaped as a rounded lip with an overhanging portion. Peripheral walls 292 extend downwardly and inwardly from lower surface 280*b*, at a position interior to rim 284. Walls 292 are generally inwardly sloped to the same degree as peripheral walls 242 of bowl 24. Walls 292 include cut-out portions 290**.

As shown in FIG. 2, a plurality of fractional length bowls 24 are disposed in any selected cavity 60, and are supported therein by bottom ribs 248 resting on lower interior surfaces 59. Peripheral walls 242 extend above the upper surface of rims 56 such that rim 244 is not in contact therewith. Lids 28 are disposed in bowls 24 and are supported by rims 284 resting upon rims 244. Walls 292 extend along the interior surfaces of walls 242 to secure the lid against lateral movement with respect to the bowl. Cover portion 3 is disposed on tray portion 5 such that lower cavity 60 corresponds with upper cavity 30 to create food storage cavity 100 in which bowls 24 and their respective lids are thermally insulatedly disposed.

Figure 30:
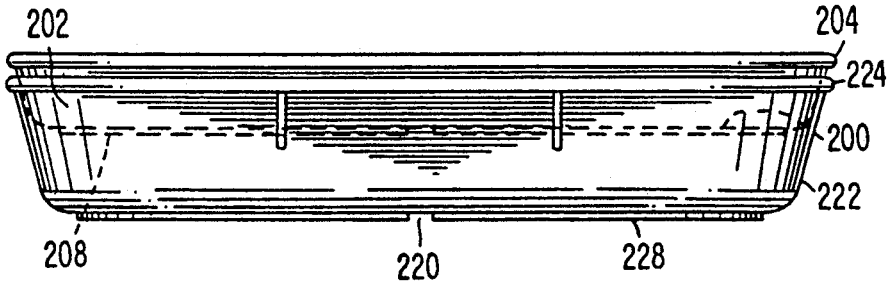
FIG. 30 is a side view showing the bowl shown in FIGS. 14–17 disposed within the bowl shown in FIGS. 10–13.

With reference to FIGS. 3 and 30, a further feature of the invention is shown. Fractional depth bowl 20 is disposed within full-sized bowl 22, and is supported therein by the contact of the outer surface of peripheral wall 202 of bowl 20, with the inner surface of peripheral wall 222 of bowl 22. Thus, the exterior surface of bottom 200 of bowl 20 is disposed substantially above the interior surface of bottom 220 of bowl 22. If it is desired to store and serve two different types of food portions which are to be maintained at the same temperature, the desired amount of the first food portion is first placed in full-sized bowl 22. This amount would be substantially less than the full amount bowl 22 can store. Fractional depth bowl 20 is then inserted in bowl 22 such that the exterior surface of bottom 200 is out of contact with the serving portion in full sized bowl 22. The desired serving amount is then placed in fractional bowl 20, which is covered by lid 26. Since bowl 20 completely covers the serving portion in bowl 22, a single lid 26 may be used to cover both serving portions.

The combined bowls 20, 22 and lid 26 are inserted in a selected lower cavity 60. Thus, the combination of the fractional sized bowl within the full-sized bowl eliminates wasted storage space when less than two full-sized serving portions are desired. The lidded combined bowls are then covered by cover portion 3 to insulate the serving portions. As seen in FIG. 2, tacking notches 42 in cover portion 3 serve the second purpose of providing clearance for handgrip 266 of lid 26 disposed on the combination of bowl 20 disposed in bowl 22.

Figure 31:
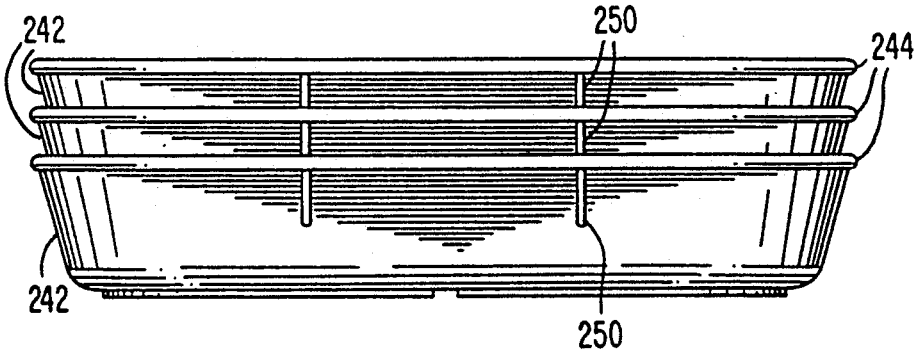
FIG. 31 is a side view showing a plurality of stacked bowls of one type of bowl as shown in either FIGS. 10–13 or FIGS. 22–25.

With reference to FIG. 31, a further feature of the present invention is shown. A plurality of stacked bowls 24 are shown, such that an upper bowl is supported in the bowl immediately beneath due to the contact between peripheral ribs 250 and the inner surfaces of peripheral walls 242. The exterior surface of bottom 240 of the upper bowl is kept out of contact with the interior surface of bottom 240 of the bowl immediately beneath. Therefore, an air circulation space is maintained by ribs 250 to allow air to circulate to all spaces between the surfaces of the bowls. Thus in the present invention, the bowls may be stacked after washing, for space saving drying. It should be noted that although only bowls 24 are shown as being stacked in FIG. 31, this principle applies equally as well to bowls 22 which are supported in the stack by peripheral ribs 230.

It should also be noted that a plurality of lids 26 or 28 may be stacked as well with lids of the same type. In such a stack, for example, with respect to lid 28, peripheral walls 292 of the upper lid would rest on upper surface 280*a* of the lower lid, surrounding and in substantial contact with peripheral uppper projection 282 to secure the lids against lateral movement with respect to each other. Peripheral walls 292 are deep enough so as to maintain handgrip 286 of the lower lid out of contact with lower surface 280*b* of the upper lid. Additionally, openings 290 in peripheral walls 292 provide air circulation between the lids to allow the lids to be washed, and then stacked during drying.

It should also be noted that although peripheral ribs are not shown with respect to fractional-depth bowl 20 due to the stacking feature within bowl 22, it is foreseen that these ribs could be used. The ribs would be inserted in corresponding notches formed on the inner surfaces of peripheral walls 222 of bowl 22, such that bowl 20 would still be supported in bowl 22 with bottom 200 disposed above the food in bowl 22. The ribs and notches of bowls 22 would be disposed at a different locations along the outer and inner surfaces of peripheral walls 222, respectively. Therefore, bowls 22 would still stack as shown in FIG. 31 for drying purposes.

The present invention provides an economical way for multiple food serving portions to be stored and served. Although FIG. 2 shows two half-length bowls disposed in one cavity, one half-depth bowl in a second cavity, and one full-sized bowl in a third cavity, the invention is not restricted in this manner. For example, six half length bowls could be used, or three full-sized or half-depth bowls could be used, or three half-depth bowls disposed in three full-sized bowls could be used. Any desired combination of bowls can be used to meet the needs of the occasion, in dependence on the number of different types of food portions needed, the configuration of the food portions, and the amount of each food portion desired. The invention is flexible enough to cover many situations in an economical, space saving manner. The desired amount of each food portion is securely retained in the bowls in each cavity, such that the food portions are insulated from the environment and other food portions. Thus, one apparatus could be used to transport and serve both hot and cold food portions such that the portions are thermally insulated from each other. The need for separate apparatuses for cold and hot food is eliminated.

This invention has been described in detail in connection with the preferred embodiments. These embodiments, however, are merely for example only and the invention is not restricted thereto. It will be understood by these skilled in the art that other variations and modifications can easily be made within the scope of this invention as defined by the claims.

We claim:

1. A multi-partition and multiple portion food storage and service apparatus comprising:

a tray portion including a plurality of tray cavities formed therein, said tray portion formed of an insulating material such that said tray cavities are insulated from each other;

a cover portion including a plurality of cover cavities formed therein, said cover portion formed substantially of an insulating material, each said cover cavity corresponding to one of said tray cavities such that when said cover portion is disposed on said tray portion, each said cover cavity is disposed above the corresponding tray cavity to form a bowl holding cavity;

a plurality of bowls, said bowls removably disposable in said bowl holding cavities;

wherein, each of said bowl holding cavities has an identical shape and size, said bowl holding cavities approximately conforming to the shape of said bowls whereby only one bowl may be disposed in said at least one bowl holding cavity or more than one bowl may be disposed in said at least one bowl holding cavity such that in the latter case said bowl holding cavity substantially conforms to said more than one bowl taken together.

2. A multi-partition and multiple portion food storage and service apparatus comprising:

a tray portion including a plurality of tray cavities formed therein, said tray portion formed of an insulating material such that said tray cavities are insulated from each other;

a plurality of bowls, at least some of said bowls removably disposable in more than one of said tray cavities;

a cover portion including a plurality of cover cavities formed therein, said cover portion formed substantially of an insulating material, each said cover cavity corresponding to one of said tray cavities such that when said cover portion is disposed on said tray portion, each said cover cavity is disposed above the corresponding tray cavity to form a bowl holding cavity;

wherein, at least one of said bowl holding cavities has dimensions which allow it to approximately conform to the shape of said bowls whereby only one bowl may be disposed in said at least one bowl holding cavity or a plurality of bowls may be disposed in said at least one bowl holding cavity such that in the latter case said bowl holding cavity approximately conforms to said plurality of bowls taken together.

3. A multi-partition and multiple portion food storage and service apparatus comprising:

a tray portion including a plurality of tray cavities formed therein, said tray portion formed of an insulating material such that said tray cavities are insulated from each other;

a plurality of bowls, said bowls selectable from at least a first group of bowls having a first length and a second group of bowls having a second length which is different than the first length;

a cover portion including a plurality of cover cavities formed therein, said cover portion formed substantially of an insulating material, each said cover cavity corresponding to one of said tray cavities such that when said cover portion is disposed on said tray portion, each said cover cavity is disposed above the corresponding tray cavity to form a bowl holding cavity; wherein, bowls of the first group are removably disposable in at least one of said bowl holding cavities such that said at least one of said bowl holding cavities approximately conforms to the shape of said bowls of said first group, and bowls of the second group are removably disposable in said at least one of said bowl holding cavities such that said at least one of said bowl holding cavities substantially conforms to the shape of a plurality of said bowls of the second group taken together.

4. A mult-partition and multiple portion food storage and service apparatus comprising:

a tray portion including a plurality of tray cavities formed therein, said tray portion formed of an insulating material such that said tray cavities are insulated from each other, said tray portion including a border region extending about the periphery of said tray portion:

a plurality of bowls removably disposable in one or more of said tray cavities, each said bowl sized to hold a plurality of serving portions, said bowls selectable from at least a first type of bowl having a length which allows said first type of bowl to extend substantially across said tray portion between opposite sides of said border region, and a second type of bowl having a length less than the length of said first type of bowl:

a cover portion including a plurality of cover cavities formed therein, said cover portion formed substantially of an insulating material, each said cover cavity corresponding to one of said tray cavities such that when said cover portion is disposed on said tray portion, each said cover cavity is disposed above the corresponding tray cavity to for a bowl holding cavity;

wherein, the inner surface of said bowl holding cavities are shaped to approximately conform to the outer surfaces of said bowls whereby only one bowl of the first type may be disposed in a bowl holding cavity to extend substantially across the bowl holding cavity and a plurality of bowls of the second type may be disposed in a bowl holding cavity such that the plurality of bowls together extend substantially across the bowl holding cavity.

5. A multi-partition and multiple portion food storage and service apparatus comprising:

a tray portion including a plurality of tray cavities formed therein, said tray portion formed of an insulating material such that said tray cavities are insulated from each other;

a plurality of bowls removably disposable in one or more of said tray cavities, said bowls selectable from at least a first type of bowl having a first length and second type of bowl having a second length different from the first length;

a cover portion including a plurality of cover cavities formed therein, said cover portion formed substantially of an insulating material, each said cover cavity corresponding to one of said tray cavities such that when said cover portion is disposed on said tray portion, each said cover cavity is disposed above the corresponding tray cavity to form a bowl holding cavity;

wherein, the bowls of both said first and second type have at least one equal dimension having a magnitude approximately equal to the magnitude of the corresponding dimension of each of said bowl holding cavities.

6. The apparatus recited in claim 5, the inner surface of said bowl holding cavities shaped to approximately conform to the outer surfaces of said bowls whereby only one bowl may be disposed in a bowl holding cavity and extends substantially across the bowl holding cavity or more than one bowl may be disposed in a bowl holding cavity such that said more than one bowls together extend substantially across the bowl holding cavity.

7. A bowl for use in a multi-partition and multiple portion food storage and service apparatus, the apparatus comprising:

a tray portion including a plurality of tray cavities formed therein, the tray cavities defined by a plurality of inclined walls, the tray portion formed of an insulating material such that the tray cavities are insulated from each other, and a cover portion including a plurality of cover cavities formed therein, the cover portion formed substantially of an insulating material, each cover cavity corresponding to one of the tray cavities such that when the cover portion is disposed on the tray portion. each cover cavity is disposed above the corresponding tray cavity to form a bowl holding cavity;

said bowl comprising a plurality of walls inclined in generally the same manner as the tray cavity walls, said bowl shaped to be removably disposable in the bowl holding cavities with the bowl holding cavities approximately conforming to the shape of said bowl whereby only one bowl may be disposed in a bowl holding cavity or a plurality of bowls may be disposed in a bowl holding cavity such that in the latter case the bowl holding cavity approximately conforms to the shape of the plurality of bowls taken together.

* * * * *